US006111393A

United States Patent [19]

Regazzi et al.

[11] Patent Number: 6,111,393

[45] Date of Patent: Aug. 29, 2000

[54] PHASE-CONTROLLED VOLTAGE REGULATION WITH MINIMAL ENERGY LOSS

[75] Inventors: Gianni Regazzi, Bologna; Pierluigi Calabri; Sergio Bianco, both of San Lazzaro Di Savena, all of Italy

[73] Assignee: Ducati Energia S.p.A., Bologna, Italy

[21] Appl. No.: 09/324,888

[22] Filed: Jun. 3, 1999

[30] Foreign Application Priority Data

Jun. 19, 1998 [IT] Italy ..... MI98A1410

[51] Int. Cl.[7] ..... G05F 1/455

[52] U.S. Cl. ..... 323/243; 323/267

[58] Field of Search ..... 323/237, 241, 323/242, 243, 267, 320, 322, 326

[56] References Cited

U.S. PATENT DOCUMENTS 4,300,900 11/1981 Weber ..... 323/267
4,504,777 3/1985 Baver ..... 323/242
4,878,010 10/1989 Weber ..... 323/324
4,948,987 8/1990 Weber ..... 323/239
5,598,039 1/1997 Weber ..... 307/38
5,630,404 5/1997 Regazzi et al. ..... 123/602
5,995,391 11/1999 Davies et al. ..... 323/243

*Primary Examiner*—Jeffrey Sterrett
*Attorney, Agent, or Firm*—Young & Thompson

[57] ABSTRACT

A phase-controlled voltage regulator of the series type, for supplying A.C. and D.C. electric loads in electronic ignition systems for internal-combustion engines. The A.C. and/or D.C. electric load is connectable in series with a single winding magneto generator via a respective electronic control switch; the voltage existing on the electric load is continuously detected and set to a supply voltage value required by the load by controlling the start time, and the time length of activation of the electronic control switch, during each half-wave of the generator voltage having a same polarity, in relation to the detected voltage on the electric load itself; no-load operating conditions for the magneto generator are maintained during the initial period of time for each half-wave, inhibiting the conduction of the electronic control switch.

18 Claims, 5 Drawing Sheets

VG
α(ωt)

V3 max
VC
V3
α(ωt)

VR3
ΔV2
α(ωt)

VL
VL
VB
α1
α2
α(ωt)

IB
α(ωt)
α3

PHASE-CONTROLLED VOLTAGE REGULATION WITH MINIMAL ENERGY LOSS

BACKGROUND OF THE INVENTION

The present invention relates to a phase-controlled voltage regulator of the series type, which can be normally used for supplying alternating-current (A.C.) and/or direct-current (D.C.) to electric loads which are connectable to a voltage magneto generator for the ignition system of internal-combustion engines of motor vehicles or for other possible applications.

STATE OF THE ART

Usually available alternating-current (A.C.) and/or direct-current (D.C.) voltage regulators as per FIG. 1 of the accompanying drawings, comprise a D.C. part provided with an electronic control switch, for example an SCR1 connected in series between the windings W1 and W2 of a magneto generator, and a D.C. load consisting for example of a battery BA; the control switch SCR1 is switched-ON by the output voltage of the generator when the voltage VB of the battery BA falls below a value determined by the voltage drop of a Zener diode DZ connected in series with a directly biased diode D1.

The A.C. part of the voltage regulator usually provided for feeding an A.C. load L conversely operates in the manner of a shunt regulator since an electronic switch SCR2, controlled by a voltage control circuit, short-circuits the negative voltage half-waves supplied by the winding W2 when the effective voltage on the A.C. electric load consisting of one or more amps L, exceeds the nominal value, normally equal to 13.5 volts.

This type of voltage regulator has several defects and drawbacks: in particular the voltage on the A.C. cad L depends to a certain extent on the charging condition of the battery BA, since a portion W2 of the generator winding is common to both the types of A.C. and D.C. loads to be fed; an intermediate outlet is required for the generator, to dissipate the energy in excess onto the winding W2 when the A.C. load L is short-circuited by SCR2. Moreover, in this type of system the generator is provided with a separate winding W3 for supplying power to a conventional electronic ignition system CDI, as schematically shown in FIG. 1; the use of several or separate windings requires time consuming wiring connections from the voltage generator and additional costs.

These problems have been partly solved with the power supply device described and illustrated in FIG. 3 of U.S. Pat. No. 5,630,404 to which specific reference is made.

The voltage regulating system disclosed by the above mentioned US patent also comprises an electronic control switch connected in parallel with A.C. and D.C. electric loads, which short-circuits to earth the generator winding when voltages fed to both the A.C. and D.C. loads have reached the correct voltage values.

This known system therefore involves the flow of a large quantity of current both in the windings of the voltage generator and in the voltage regulator, and a high energy dissipation also when the electric loads are not being powered.

This results in two negative effects: the first one is that more power is drawn from the vehicle engine, with consequent greater fuel consumption and atmospheric pollution, while the second effect is that the dissipated electric power causes a rise in the temperature of the generator and the same voltage regulator, adversely affecting the reliability thereof.

Therefore the need exists for a solution which combines the advantage of a single winding generator having one of the two terminals connected to earth, so as to supply both the A.C. and D.C. electric loads of a motor vehicle, and the electronic ignition of the engine, with that of having a selective power supply to the A.C. and D.C. electric loads, together with a low energy loss.

OBJECTS OF THE INVENTION

The general object of the present invention is therefore to provide a method for the voltage regulation of a magneto generator, particularly suitable for use in ignition systems for internal-combustion engines of motor vehicles and the like, by means of which it is possible to supply in a selective and phase controlled manner, both alternating-current (A.C.) and/or direct-current (D.C.) electric loads, and the ignition circuit of a motor vehicle; in this way the energy losses due to the voltage regulating system are kept to a minimum and consequently the causes of overheating of the magneto generator and the same voltage regulator are substantially reduced, while keeping the electric loads and the engine ignition circuit connected to a single stator winding of the same magneto-generator.

Yet another object of the present invention is to provide a voltage regulator, as defined above, which not only allows for a reduction in the energy losses and in the fuel consumption of the engine, but also allows certain requirements of motor vehicle manufacturers to be satisfied; in fact, it is required that the power generated by the engine should be increasingly and mainly used for tractional purposes, with a minimum part of the engine power being used for the generation of the electrical energy in an amount sufficient for powering the electric loads and the engine ignition system of a motor-vehicle and the like.

BRIEF DESCRIPTION OF THE INVENTION

These and other objects may be achieved by a method for the regulation of the output voltage of a magneto generator which is fed to A.C. and/or D.C. electric loads and an ignition system of a motor-vehicle, according to claim 1, and to a voltage regulator device according to independent claims 6 and 7.

More precisely, according to a general embodiment of the invention, a method has been provided for regulating the voltage (VL, VB) supplied to A.C. and/or D.C. electric loads (L, BA) connected to a single winding magneto generator (W4), and to the ignition circuit for an internal-combustion engine of a motor-vehicle, in which the electric loads (L, BA) are supplied with half-waves of the output voltage (VG) of the magneto generator having a first polarity, comprising the steps of:

connecting the electric loads (L, BA) to the single winding (W4) of the magneto generator, by an electronic control switch (T1, T2) for controlling the voltage (VL, VB) supplied in the electric loads (L, BA) during each feeding phase;

detecting the voltage (VL, VB) existing on the electric loads (L, BA);

regulating the voltage (VL, VB) supplied to the electric loads (L, BA) by controlling the start and the time length of conductive state of the control switch (T1, T2), in relation to the voltage (VL, VB) detected on the electric loads (L, BA), during each period of the output voltage half-waves of the magneto generator having said first polarity; and maintaining no-load working conditions of the magneto generator during an initial period of time ($\alpha 1$) of each voltage half-wave, in which said control switch (T1, T2) is in a non-conductive state.

According to a first preferred embodiment of the invention, a method has been provided for regulating the voltage (VL) supplied to an A.C. electric load connectable to a single winding magneto-generator (W4) through an electronic control switch (T1), the method comprising the steps of:

detecting the voltage (VL) on the A.C. electric load (L);

providing a first control voltage (V2) related to the detected voltage (VL) on the A.C. electric load (L);

generating a voltage ramp (VC) related to, and during each of the voltage half-waves (VG) of the magneto generator (W4) having a first polarity, zeroing said voltage ramp (VC) during each voltage half-wave having a second polarity opposite to the preceding one; and triggering the control switch (T1) into a conductive state to supply power to the A.C. electric load (L) by applying to the control gate of the control switch (T1) a second control voltage (VF) provided by the comparison of said voltage ramp (VC) with said first control voltage (V2), for an angle ($\alpha 2$) of each half-wave of said first polarity having a length sufficient to maintain the required nominal voltage (VL) on the A.C. electric load (L).

According to a second preferred embodiment of the invention, a method has been provided for regulating the voltage (VL, VB) supplied to A.C. and D.C. electric loads (L, BA) selectively connectable to a single winding magneto generator (W4) through a respective electronic control switch (T1, T2), the method comprising the steps of:

detecting the voltages (VL, VB) on the electric loads (L, BA);

providing first and second control voltages (V2, V3) related to the detected voltages (VL, VB) on the electric loads (L, BA);

providing a first reference voltage (VR4) indicative of the nominal voltage of the D.C. electric load (BA);

generating a voltage ramp (VC) related to, and during each of the voltage half-waves (VG) of the magneto generator (W4) having a first polarity, zeroing said voltage ramp (VC) during each voltage half-wave having a second polarity opposite to the preceding one;

providing a threshold voltage (VR3); and triggering said control switches (T1, T2) into a conductive state to selectively supply the A.C. and respectively the D.C. electric loads (L, BA) by applying to the control gate of the control switches (T1, T2) a control voltage (VN, VF') provided by comparing said first control voltage (V2) with said threshold voltage (VR3) and said second control voltage (V3) with said voltage ramp (VC) respectively for an angle ($\alpha 2$, $\alpha 3$) of each half-wave of said first polarity, having a length sufficient to maintain the required nominal voltages (VL, VB) on the electric loads (L, BA).

According to another embodiment of the invention, a phase-controlled voltage regulator of the series type for an A.C. electric load (L) has been provided, in which the A.C. electric load (L) is connectable in series to a single winding (W4) of a magneto generator during each half-wave of a first polarity, by an electronic switch (T1) controlled in relation to a voltage (VL) detected on the load itself, characterized by comprising:

an A.C. load voltage-detection unit (B) to provide a first control voltage (V0) proportional to the square value of the voltage (VL) detected on the A.C. electric load (L);

an inverting integrator unit (C) having an inlet (−) connected to the outlet (V0) of said A.C. voltage detection unit (B) to provide a second control voltage (V1) related to the voltage (VL) supplied to the A.C. electric load (L) and to a first reference voltage VR1) indicative of the effective voltage (VL) of the A.C. load (L);

a voltage inverting unit (D) having an inlet (−) connected to the outlet of said inverting integrator (C) to invert said second control voltage (V1) with respect to a second reference voltage (VR2) providing a third control voltage (V2) related to the effective voltage (VL) for the A.C. electric load (L);

a voltage-ramp generating unit (E) to provide a voltage ramp (VC) related to each half-wave of a first polarity of the output voltage (VG) of the magneto generator, zeroing the voltage ramp (VC) during each half-wave having a second polarity opposite to the preceding one; and a voltage comparator (F') to compare said voltage ramp (VC) with said third control voltage (V2) to apply during each half-wave of the first polarity, a control voltage (VF) to the control gate of the electronic switch (T1) to connect the A.C. electric load (L) to the single winding (W4) of the magneto generator.

According to yet another aspect of the invention a phase controlled voltage regulator of the series type has been provided, in particular for A.C. and D.C. electric loads (L, BA), in which the A.C. and D.C. electric loads (L, BA) are selectively connectable to a single winding (W4) of a magneto generator during each half-wave of the output voltage (VG) having a same polarity, characterized by comprising:

a first A.C. load voltage detection unit (B) to provide a first control voltage (V0) proportional to the square value of the voltage (VL) detected on the A.C. electric load (L);

an inverting integrator unit (C) having an inlet (−) connected to the outlet (VO) of said A.C. voltage detection unit (B) to provide a second control voltage (V1) related to the voltage (VL) supplied to the A.C. electric load (L) and to a first reference voltage (VR1) indicative of the effective voltage (VL) of the A.C. load (L);

a voltage inverting unit (D) having an inlet (−) connected to the outlet of said inverting integrator (C) to invert said second control voltage (V1) with respect to a second reference voltage (VR2) providing a third control voltage (V2) related to the effective voltage (VL) for the A.C. electric load (L);

a voltage-ramp generating unit (E) to provide a voltage ramp (VC) related to each half-wave of a first polarity of the output voltage (VG) of the magneto generator, zeroing the voltage ramp (VC) during each half-wave having a second polarity opposite to the preceding one; in that it comprises a first voltage comparator (CP2) to compare said third control voltage (V2) with a threshold voltage (VR3) to generate a gate control voltage (VF') for the D.C. load control switch (T2) during each positive half-wave of the voltage (VG) of the magneto generator;

a D.C. voltage detection unit (I) to provide a fourth control voltage (V3) indicative of the voltage of the D.C. electric load (BA) in respect to a reference voltage (VR4) indicative of the nominal voltage for the D.C. electric load (BA);

in that a second voltage comparator (CP1) has been provided to compare said ramp voltage (VC) with said fourth control voltage (V3) the voltage output (VN) of said second voltage comparator (CP1) being connected to the control gate of the A.C. load control switch (T1), to sequentially control a non conductive state and respectively a conductive state of said A.C. and D.C. control switches during each voltage half-wave of the magneto generator (W4), having said first polarity.

BRIEF DESCRIPTION OF THE DRAWINGS

The general features of the present invention and some preferred embodiments will be described more fully hereinbelow with reference to the examples of the accompanying drawings, in which.

DETAILED DESCRIPTION OF THE INVENTION

Figure 1:
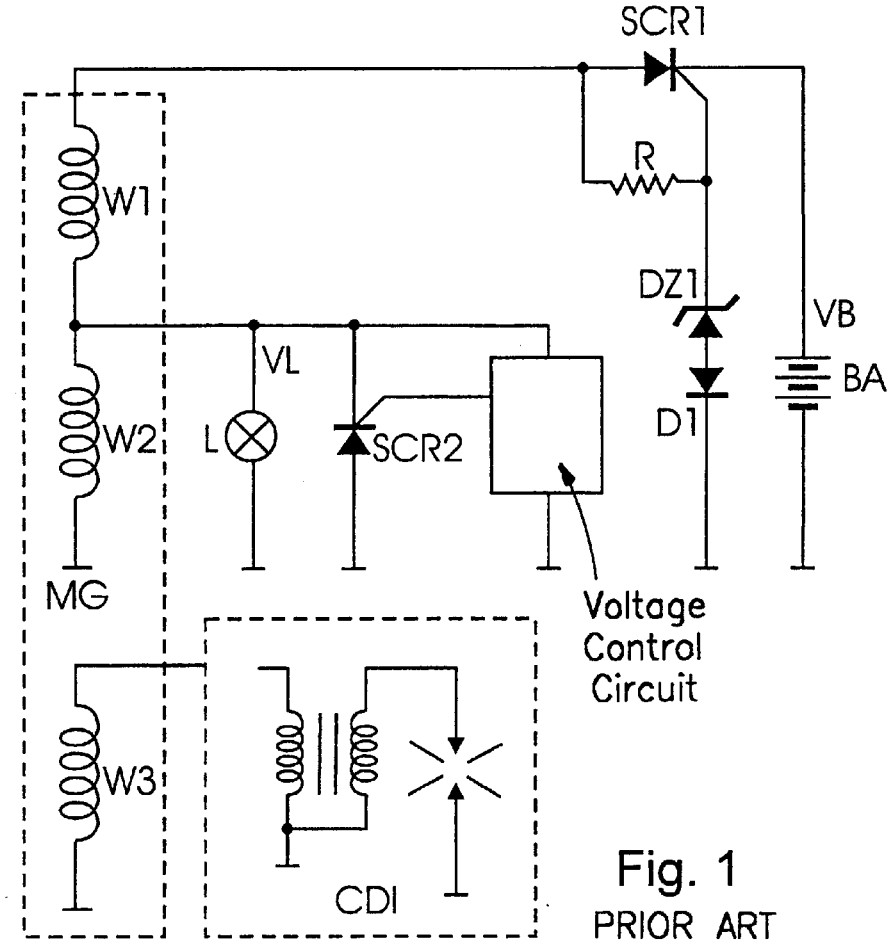
Fig. 1 PRIOR ART
FIG. 1 is a general diagram of a conventional A.C., D.C. voltage regulator and a capacitive-discharge ignition system (CDI)

As mentioned previously, the example according to FIG. 1 relates to a conventional voltage regulator connected to the two windings W1 and W2 of a magneto generator MG for supplying both an alternating-current A.C.) electric load L and a direct-current (D.C.) electric load comprising a battery BA; a third winding W3 of the generator MG supplies a capacitive-discharge electronic ignition system CDI of the conventional type, which is schematically shown.

First Preferred Embodiment

Figure 2:
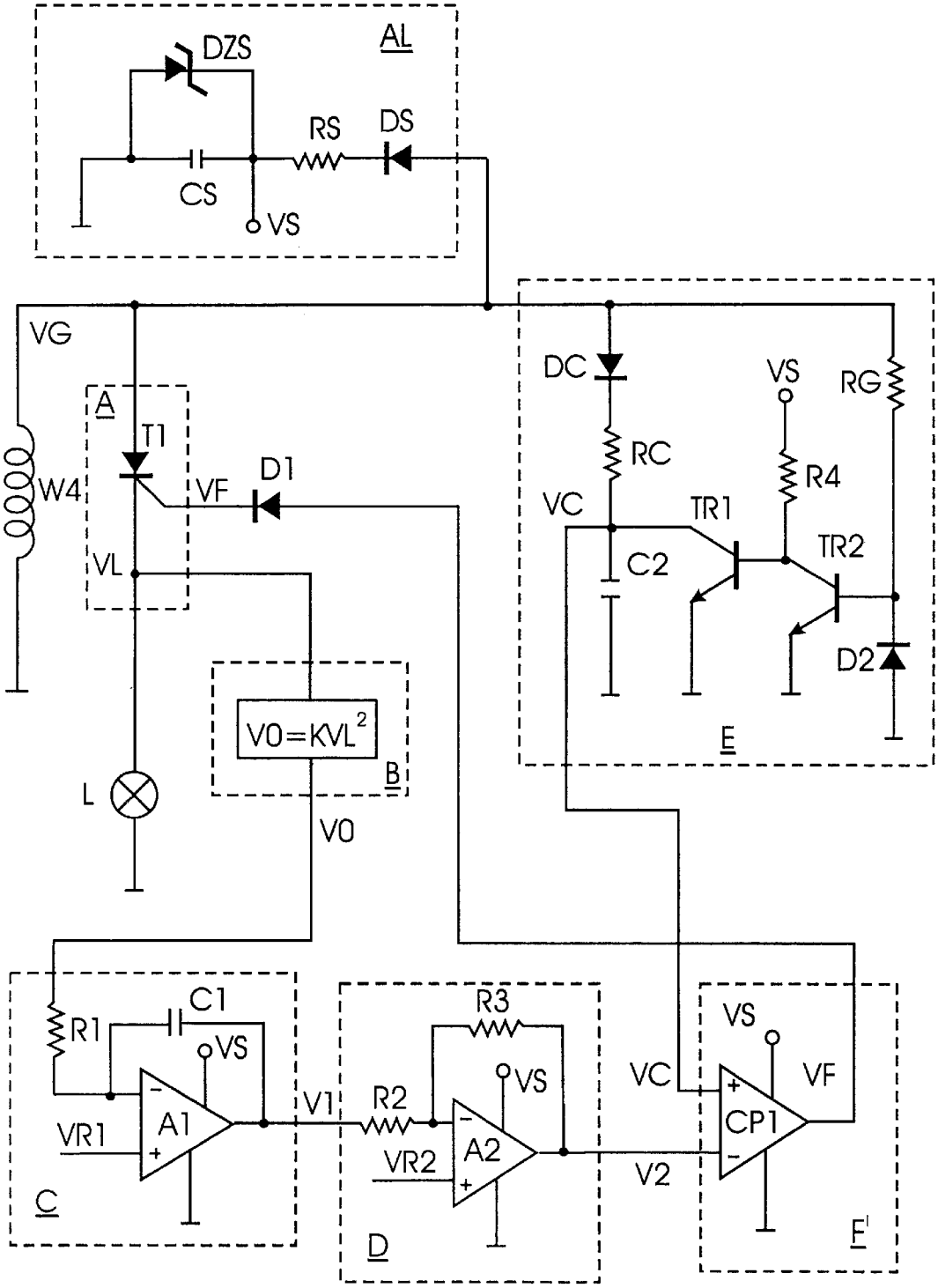
FIG. 2 is a general diagram of a voltage regulator according to a first embodiment of the invention, suitable for an A.C. load.

FIG. 2 of the drawings shows a first preferred embodiment of the invention, which uses a single power winding magneto generator W4 both for supplying a capacitive-discharge electronic ignition, not shown, for example of the type described in U.S. Pat. No. 5,630,404 and for supplying an alternating-current (A.C.) electric load L, by means of a phase-controlled voltage regulator of the series type.

The present invention differs substantially from the solution of the preceding patent U.S. Pat. No. 5,630,404, the capacitive-discharge ignition diagram of which is referred to briefly, since it allows phase-control supplying of the A.C. and/or D.C. electric loads which achieves a smaller dissipation of electrical energy in the generator and in the said voltage regulator and more efficient use of the engine power for tractional purposes.

The general principle of the present invention consists in selectively supplying the A.C. and/or D.C. electric loads and controlling a supply phase thereof during a portion of the individual half-waves of the generator voltage having a same polarity, which extends over an electrical angle of each half-wave, which varies in relation to changes in the working conditions of the magneto generator W4 and the load requirements, but in such a way that the effective value of the voltage supplied to the electric load by a phase-controlled voltage regulator of the series type, during such an electrical angle, corresponds substantially to the effective value of the voltage admissible for the load itself.

In the case where it is required to supply an A.C. and a D.C. electric loads, the electrical angle portion which during each half-wave is used to supply the A.C. load, for the same working conditions of the generator, is such as to maintain a correct effective voltage value on the A.C. loads, while the electrical angle portion supplying the D.C. load correspondingly varies in relation to the charging condition of a storage battery which constitutes or forms part of the D.C. load.

In the example shown, as described further below with reference to FIGS. 2 to 5, the positive half-waves of a permanent-magnet voltage generator, hereinafter also referred to as magneto generator are used to supply the A.C. electric load, while the negative half-waves of the magneto generator are used for the powering of the electronic ignition of an engine (not shown); however, the functions of the negative and positive voltage half-waves in this case could also be reversed since there are no direct-current loads which commonly would require connection to earth of the negative pole of the magneto generator.

The A.C. single-phase series type voltage regulator according to the present invention is a phase controlled regulator, a preferred embodiment of which is therefore shown in FIG. 2.

As can be seen from this figure, the voltage regulator substantially consists of six functional blocks which are indicated by the letters A, B, C, D, E and F' and which will be described separately.

More precisely, FIG. 2 shows a magneto generator having a single winding W4 with a terminal connected to earth, for the generation of an electric power to be supplied both to an A.C. electric load, represented schematically by a lamp L, and to a conventional electronic ignition circuit for combustion engines (not shown).

In FIG. 2 AL denotes moreover a block for generating a voltage VS supplying the individual functional units of the voltage regulator; the block AL comprises, for example, a diode DS and a resistor RS in series with a capacitor CS, the charging voltage VS of which is stabilised by a Zener diode DZS in parallel with the capacitor CS.

Passing to the description of the individual functional units which make up the voltage regulator, the unit A consists of an electronic control switch T1, for example an SCR which can be connected to the winding W4 of the magneto generator in series to the A.C. load L so as to supply the latter during an electrical angle α2 (FIG. 5) successive to the angle α1, starting from a predefined point of each positive half-wave of the output voltage VG from the magneto generator W4, until the time when there is no more current flowing through it.

As previously mentioned, the innovative aspect of the present invention consists in supplying the electric load by each half-wave having a same polarity, effecting the control of the conductive state of the electronic switch T1 for only a length or period of time of each half-wave, namely for an electrical angle α2 following a non conductive angle α1 during which the effective value of the output voltage of the magneto generator W4 applied to the electric load L, corresponds to the effective value of the voltage admissible for the A.C. load itself.

Therefore the voltage VL on the A.C. electric load, downstream of the electronic control switch T1, is detected by a voltage detecting unit B which provides, at its output, a voltage V0 proportional to the square of the input voltage VL, i.e. defined by the formula:

$$V0=KVL^2$$

where K is a constant of predefined value such that the voltage V0, subsequently integrated, is proportional to the "effective value" of the voltage VL on the load L which, according to the well-known formula, consists of the square root of the mean of the squares of the values for the parameter VL considered.

The above may be obtained by applying the classic principles of transconductance analog or logarithn-antilogarithm multipliers and in other ways as well.

More precisely, in the case shown, the output V0 of the unit B is supplied to the inlet of an inverting integrator comprising the circuit R1-C1 and an operational amplifier A1, the non-inverting terminal of which is referred to a first reference voltage VR1 which determines the effective value of the admissible voltage for the A.C. load L to be supplied; in particular, it is possible to show that this effective value is equivalent to:

$$VL\ (\text{rms}) = \sqrt{\left(\frac{VR1}{K}\right)}$$

Therefore the output voltage V1 from the inverting integrator unit C rises or falls depending on whether the mean of the voltage V0 is less or greater than the reference voltage VR1.

The output V1 of the unit C consisting of an inverting integrator, constitutes a first control voltage for controlling the voltage VL on the A.C. load L, which is sent to the inlet of a third unit D comprising a signal inverting amplifier (A2, R2, R3) which inverts V1 with respect to a second reference voltage VR2 and the amplification ratio A of which is defined by:

$$A = \frac{R3}{R2}$$

where R2 and R3 are resistors connected to an operational amplifier A2, in the typical inverting amplifier configuration.

At the outlet of the amplifier A2 there is a second control voltage V2 which, similar to V1, is related to the effective value of the voltage VL existing on the A.C. load L as defined above. The control voltage V2 therefore varies, upon variation of V0 with respect to the reference voltage VR1, as shown in the graph according to FIG. 4, depending on whether the magneto generator schematically represented by the winding W4, is operating at no-load condition (falling section), when T1 is reversely biased or is in open and deactivated condition during the angle α1, or whether current is flowing in the A.C. load L (rising section), when T1 is closed or in conductive state during the angle α2.

The control voltage V2 is in turn applied to the inverting terminal of a voltage inverting unit F'; this unit F' substantially comprises a voltage comparator CP1 which is supplied, at its non-inverting inlet, with a voltage VC essentially consisting of a voltage ramp obtained by integration of each positive half-wave of the output voltage VG of the magneto generator W4 provided by a voltage ramp generating unit E consisting of the set of diode DC, resistor RC, capacitor C2, and zeroing said voltage VG at every negative half-wave so as to obtain a control of the starting point of the conductive phase for the electronic switch T1; in this way it is possible to supply the load L with a voltage VL for an electrical angle α2 of each positive half-wave of the voltage VG of the magneto generator following an angle α1 during which the voltage VL is zero. During each period T of voltage VG, the value of the effective voltage VL supplied to the A.C. load, which corresponds to the effective value admissible for the load itself, is defined by the following equation:

$$VL\ (\text{rms}) = \sqrt{\left(\frac{VR1}{K}\right)}$$

More precisely, the unit E for generating the voltage ramp VC for control of the conductive and non-conductive phases of T1, consists of an integrator circuit RC-C2 for solely the positive half-waves of the voltage VG of the magneto generator, since the negative half-waves, intended to supply the electronic ignition circuit of the engine, are blocked by the diode DC.

The unit E also comprises a first transistor TR1 for short-circuiting the capacitor C2, the base of which is normally biased, via the resistor R4, by the voltage VS provided for powering the various functional units of the circuit, and in which the base of TR1 is in turn connected to the collector-emitter of a second transistor TR2 for blocking the first transistor TR1, the base of which is biased by the positive voltage VG of the magneto generator by means of the resistor RG, while the reversely biased diode D2 has the function of protecting TR2 during the negative half-waves.

The voltage VC from the unit E therefore represents the integral of the voltage VG of the magneto generator, or more generally a voltage ramp related to the voltage VG of the generator, which is put to zero every time the voltage VG of the magneto generator becomes negative; in this way the unit E is always ready to operate at each half-wave or more generally for all the half-waves of the magneto generator which have a same polarity.

In substitution of the individual units A, B, C, D, E and F', it is possible to use an integrated solution consisting of a single digital unit which is governed by a microcontroller suitably programmed to carry out the various functions and which, by means of two inputs provided with analog-digital converters, is able to acquire the two signals VL and VG and perform all the functions of the various operative units described above.

Operation of the circuit according to FIG. 2 will now be briefly described with reference to the successive FIGS. 3 to 5. These figures on the left and right sides show two different operating conditions of the magneto generator, to which two different conditions of the voltages generated for control and for powering of the load L correspond.

Figure 3:
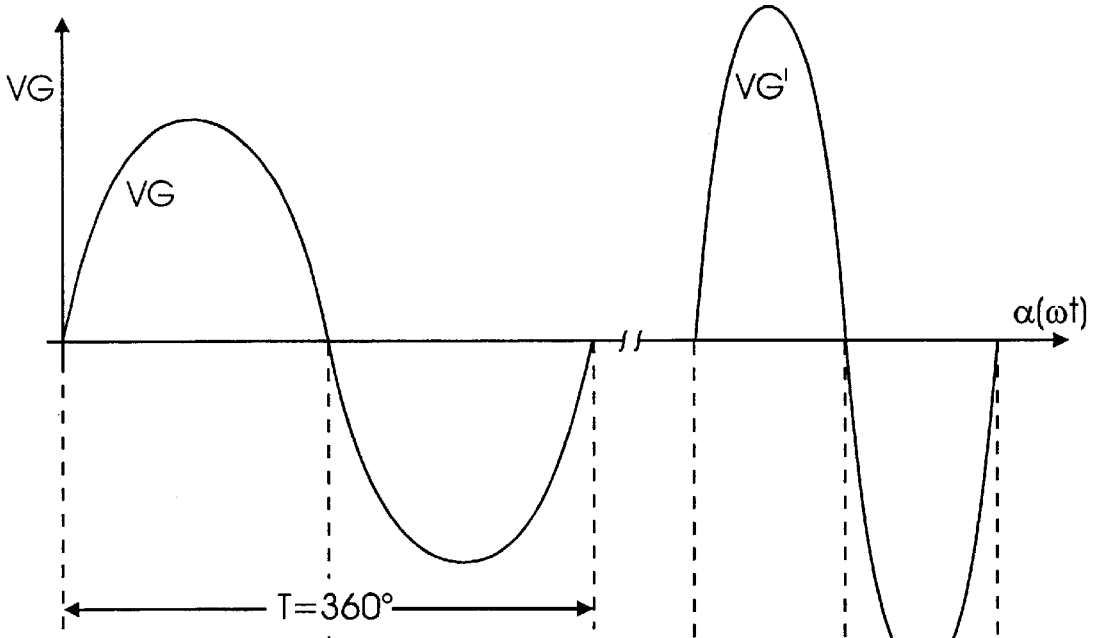
FIG. 3 shows the graph of the output voltage of the magneto generator for the voltage regulator of FIG. 2, in two different rotational speed conditions.
Figure 4:
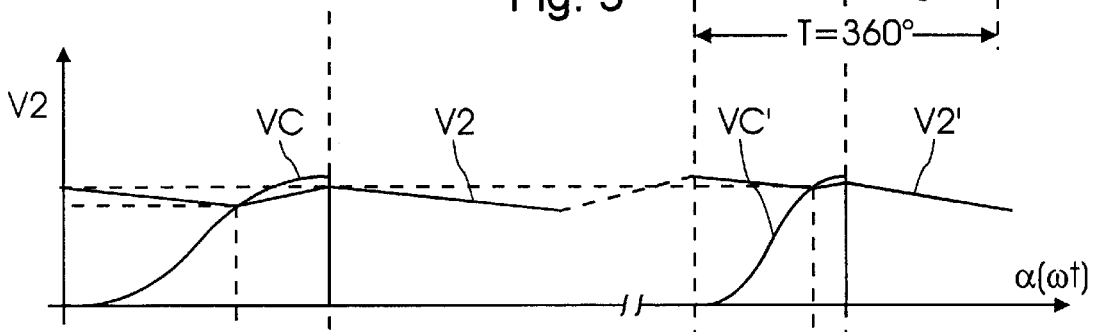
FIG. 4 is a graph illustrating the control voltage V2 related to the effective value of the A.C. load voltage, and a voltage ramp related to the voltage VG of the magneto generator, which control the electric load supply phase, in the two different conditions of FIG. 3.
Figure 5:
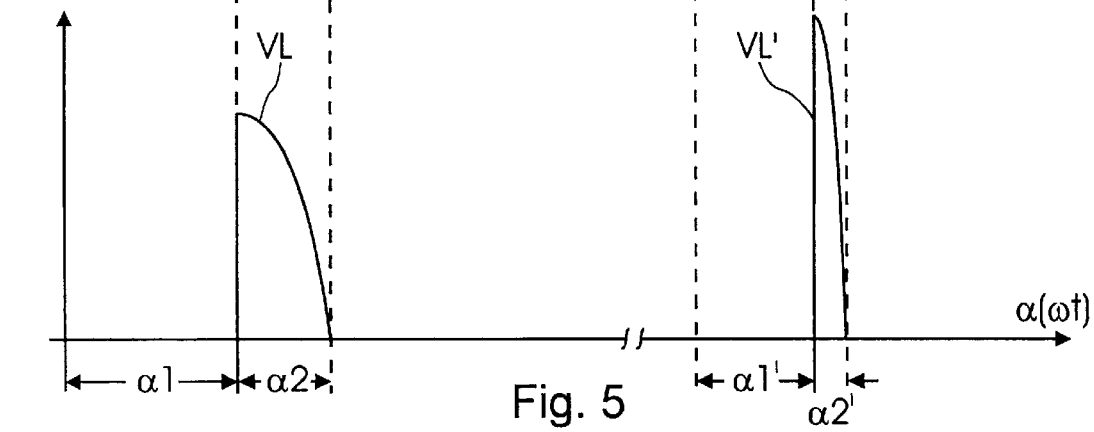
FIG. 5 is a graph of the voltage supplying the A.C. electric load during a positive half-wave of the voltage, in the two different conditions of FIG. 3.

More precisely, the left-hand part of FIGS. 3, 4 and 5 show a first operative condition of the voltage regulator, when the magneto generator is operating at a first speed of rotation, for a low number of revolutions of the engine, while the right-hand part shows a second condition when the magneto generator is operating at a rotational speed greater than the preceding one. In both cases, the voltages are shown for a single period T or T' equal to an electrical angle of 360°.

As previously mentioned, the unit B provides at its output a voltage V0 which is proportional to the square of the voltage VL existing at any time on the A.C. load L and which is integrated by the integrator C and inverted by the inverting unit D so as to provide a control voltage V2 related to the effective value of VL; V2 will then be compared with the voltage ramp VC generated by the unit E so as to obtain at the output from CP1, a control voltage VF for controlling the conductive state of the electronic switch T1, which will keep the load L connected to the magneto generator winding W4 for an electrical angle $\alpha 2$ suitable to provide on the same load L the desired effective value of the supply voltage.

The graph of the voltage VG of the magneto generator, in the first condition mentioned above, is shown in the left side of FIG. 3, while the graph of the control voltage V2 related to the effective value of the voltage VL on the load L, in addition to the ramp voltage VC, are shown again in the left side of FIG. 4.

The left side of the FIG. 5 shows, on the other hand, the voltage VL existing on the load L during control of the conductive phase of T1.

As can be seen from the above mentioned figures, when the voltage ramp VC after angle $\alpha 1$ exceeds the voltage V2 related to the effective voltage of the load L, the output VF of the voltage comparator CP1, the inlets of which are supplied by VC and V2, switches high and applied, by the diode D1 to the control gate of the electronic switch T1 so as cause it to conduct. The A.C. load L will therefore have a voltage VL corresponding to that part of the voltage VG which is present at the outlet of the magneto generator during the angle $\alpha 2$ comprised between the time when the voltages VC and V2 have the same value, and for the successive period of time of a positive half-wave of the generator, up to the time at which the voltage VG is put to zero.

In more general terms, the angle $\alpha 2$ which determines the conductive time of the switch T1 and therefore the supply phase of the A.C. load L, during each positive half-wave of the generator voltage, will be such that the effective value of the corresponding portion of the half-wave, will be equal to the effective value of the voltage which can be attributed to the load L, a value which may be preset by means of the reference voltage VR1 at the non-inverting input of the operational amplifier A1.

From the above it will therefore be evident that the voltage regulator operates so as to selectively supply the A.C. load L for a calculated portion of each half-wave of the output voltage VG of the magneto generator; therefore, during the angle $\alpha 1$ relating to the preceding portion of a same half-wave, both the voltage regulator and the magneto generator will not have any current flowing through them, the magneto generator practically operating in a no-load mode. In this way, a considerable reduction in energy dissipation and a consequent saving will be achieved, to the benefit of exploitation of the power of the engine to which the generator is connected, for traction of the associated motor vehicle.

As stated above, during the phases when the load L is not supplied and during which current is not flowing, the magneto generator is practically operating under no-load conditions; therefore, the sole losses consist of the small dissipation of power in the iron, which are comparatively much less than the losses in the copper of the magneto generator when it is short-circuited by a regulator of the parallel type, such as those which are normally used.

Purely by way of example, it may be pointed out that, for a small engine with a capacity of 50 cc, in which a magneto generator engine with a power of about 2 KW is required, using the presently known regulating systems in a condition with the battery charged and a 50 W lamp light, the magneto generator at about 8000 revolutions uses about 250 W, equivalent to about 12.5% of the power generated by the engine; of these 250 W, about 180 W are normally heat dissipated on account of the electric current flowing in the windings of the generator and in the voltage generator; the remaining 20 W are used for ignition purposes.

Since energy consumption nevertheless results in environmental pollution, and since the problems associated with environmental pollution are becoming increasingly critical, it is obvious that, according to the present invention, owing to the possibility of substantially limiting the dissipation of energy in the voltage regulator and in the same magneto generator, since the latter is made to operate practically under no-load conditions when the electric loads do not have to be supplied, all this helps reduce the causes of fuel consumption and therefore reduce the problems of atmospheric pollution, as well as allow the consumption of power for supplying of the electric loads to be limited to that which is necessary for obtaining the correct effective value of the supply voltage, independently of the operating condition of the magneto generator.

The above is confirmed by comparing the graphs on the left-hand side of the FIGS. 3, 4 and 5 with the graphs on the right-hand side which illustrate operation of the voltage regulator at a number of revolutions higher than in the preceding case and in which the same references have been used with the addition of an apex.

In this second case the voltage VG' of the generator has a greater amplitude and a smaller electrical period T'. Since the control voltage V2'tends to increase in that the effective value of the voltage VG' of the generator has increased, the voltage regulator acts nevertheless in such a way that the control switch T1 is activated and therefore conducts for an electrical angle $\alpha 2'$ which is smaller than in the preceding case, but nevertheless is such as to provide on the A.C. load L a voltage VL' such that its effective value always corresponds to the required value for the load to be supplied.

Obviously, in this second case also, for the whole of the angle $\alpha 1'$, the magneto generator G will be in no-load state and therefore no current will be flowing with a consequent improved performance compared to a magneto generator in which the voltage is regulated by a normal A.C. regulator of the shunt type. Obviously the losses in the iron as a result of no-load operation of the generator may be further limited by choosing, for the stator pack of the generator, suitable laminations made of silicon iron with a low loss coefficient.

Second Preferred Embodiment

The remaining FIGS. 6 to 11 show a second preferred embodiment of the present invention suitable for a phase-controlled voltage regulator for both alternating-current (A.C.) and direct-current (D.C.) electric loads.

Figure 6:
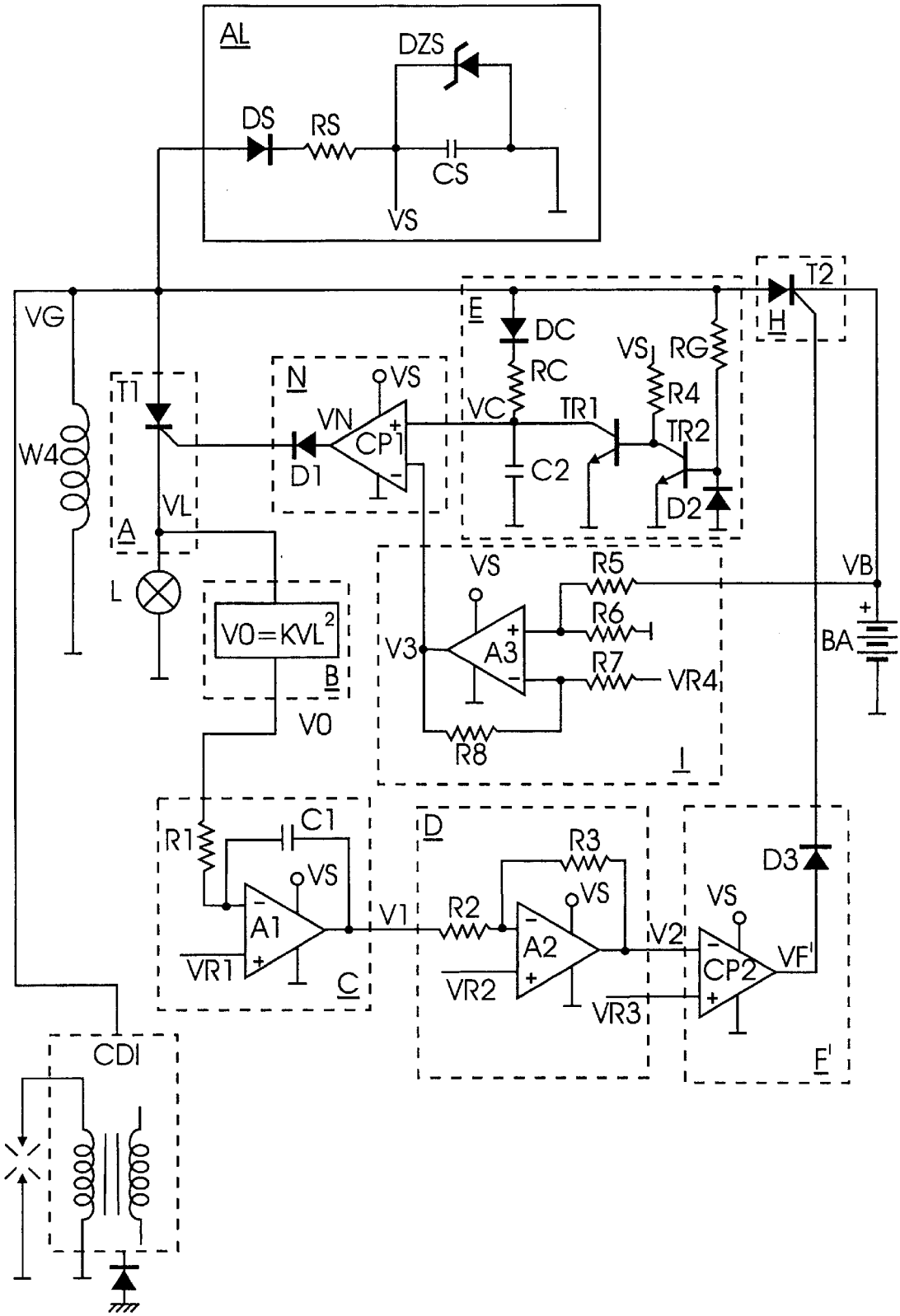
FIG. 6 shows a second embodiment of a phase controlled voltage regulator of the series type for supplying both A.C. and D.C. electric loads.
Figures 7, 8, 9, 10, 11:
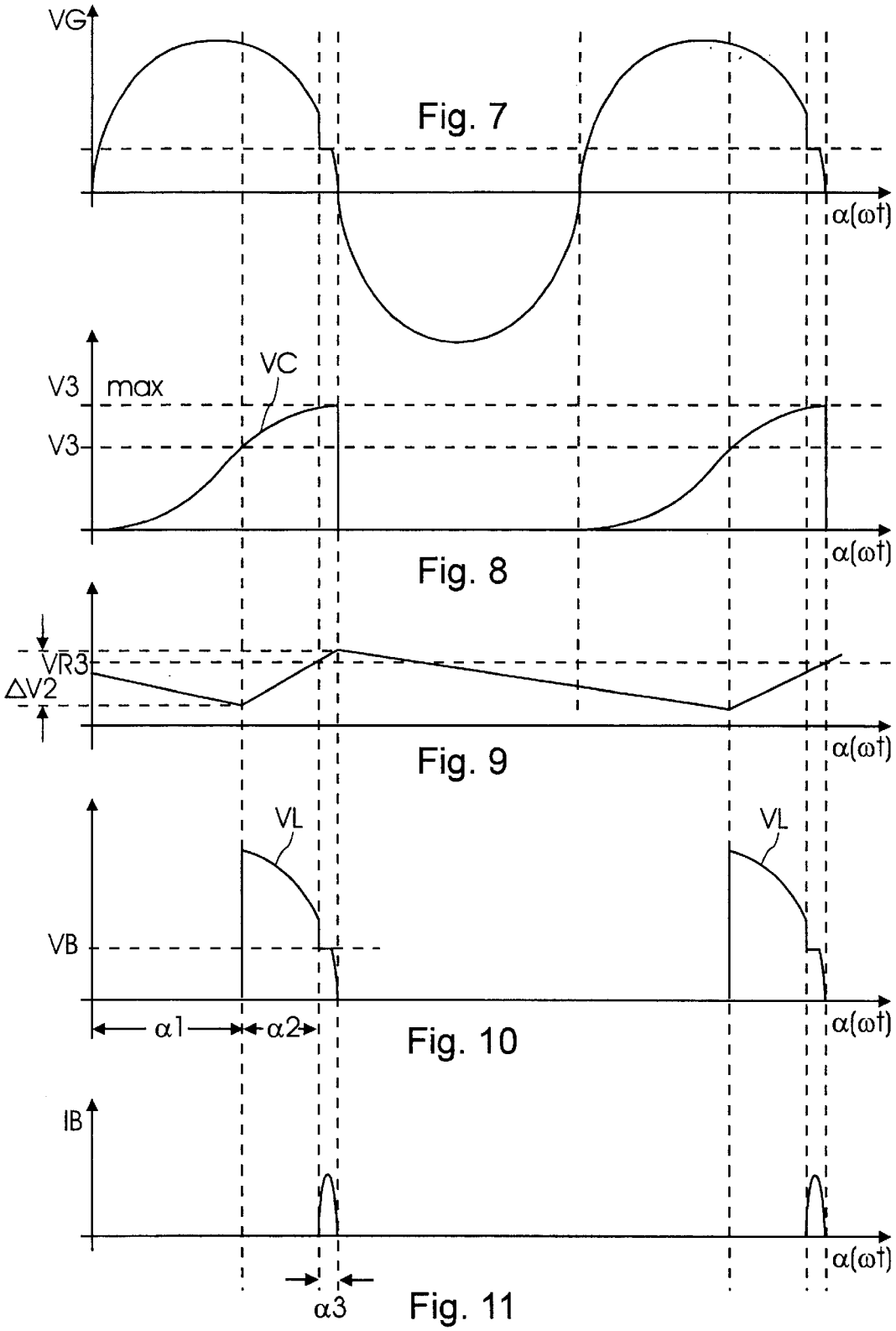
FIG. 7 shows the graph of the output voltage of the magneto generator for the voltage regulator according to FIG. 6.
FIG. 8 shows again the graph of the voltage ramp correlated to the voltage of the generator according to FIG. 7.
FIG. 9 shows the graph of the control voltage V2 related to the effective value of the A.C. electric load voltage.
FIG. 10 shows the graph of the supply voltage for the A.C. load of the regulator of FIG. 6.
FIG. 11 shows the graph of the current flowing in the D.C. load.
Figure 6:
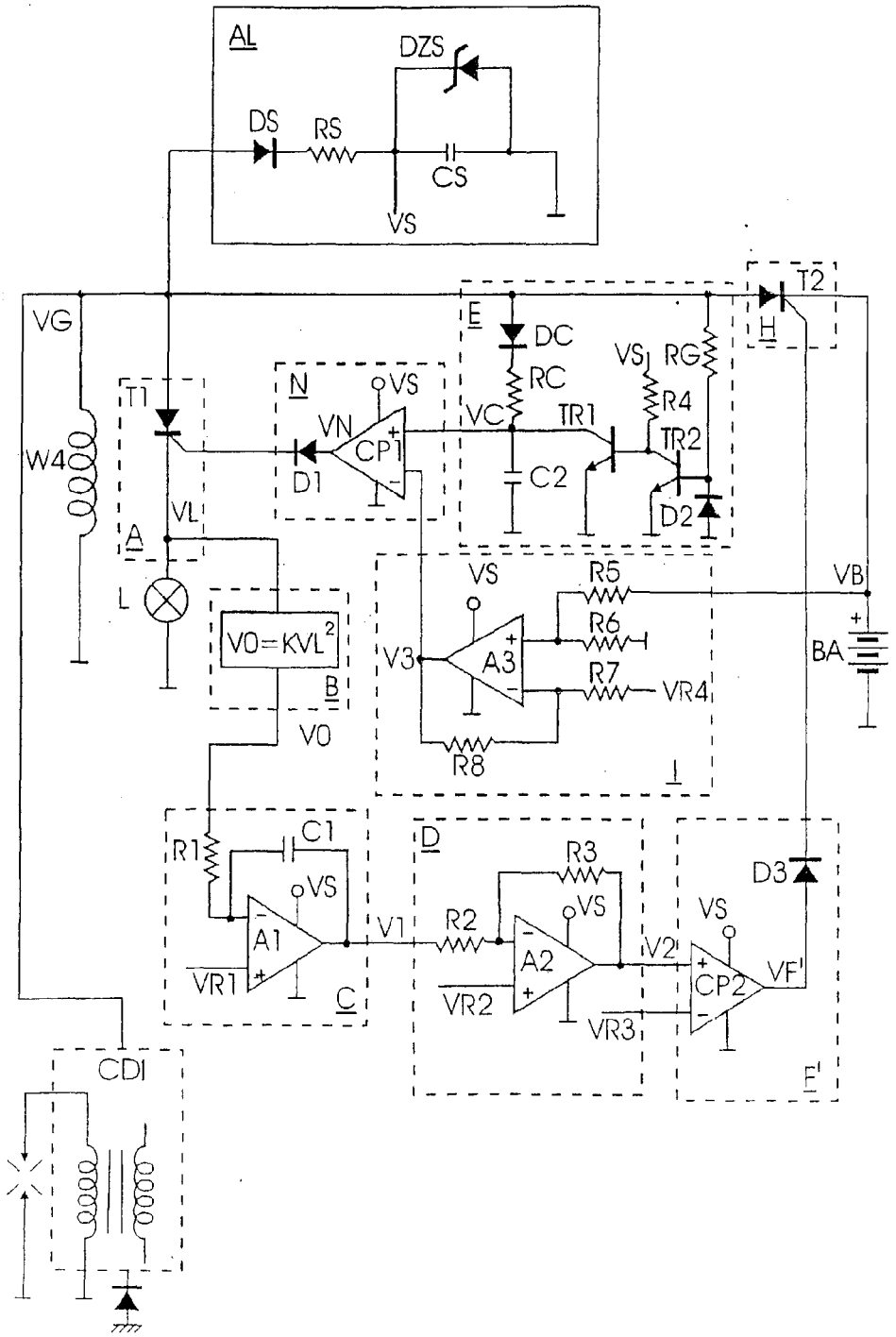

In the example according to FIG. 6, the same reference numbers as in FIG. 2 have been used for the same units A, B, C and E equivalent to the preceding ones and which will therefore be briefly referred to, while different reference numbers have been used for the additional or modified units; the voltage regulator according to FIG. 6 differs substantially from the regulator according to FIG. 2 owing to the fact that it is able to supply selectively an A.C. electric load L and a D.C. electric load for example represented by the storage battery BA, and also owing to modification of the unit F', and addition of new functional units N, H and I necessary for allowing a phase control and the selective supply of the loads L and BA, again in relation to the effective value of the voltage VL supplied the said A.C. load.

It is now standard practice for mopeds or scooters to be provided with a battery necessary for supplying the starter motor or certain lamps on the control board of the vehicle; for this reason, according to the example shown in FIG. 6, the voltage regulator must provide at its outlet two voltages VL and VB, one VL being an alternating-current voltage, in practice 13–14 volts, for supplying the A.C. load L and the other one VB being a direct-current voltage, typically 14–15 volts, for supplying the battery BA or other D.C. loads of the motor vehicle. Therefore the phase controlled voltage regulator shown in FIG. 6 still has the functional units A, B, C, D and E which functionally can be assimilated with the corresponding units of the preceding example as well as comprises a modified unit F' and the addition of three new units N, H and I for the reasons explained hereinbelow.

The unit A still consists of an electronic control switch T1, typically an SCR, connected in series with the A.C. load L, which is again supplied from the time at the control switch T1 is operated, until the time when there is no more current flowing through it.

Again the unit B provides at its outlet a voltage V0 which is proportional to the square of the input voltage VL, in accordance with that previously mentioned.

The units C and D in this case also consist of an integrator for the voltage V0 with respect to a reference voltage VR1, and a signal inverting circuit for again providing at its outlet a voltage V2 corresponding to the value of the effective voltage VL existing on the A.C. load L.

Differently from the previous case of FIG. 2, the voltage V2 is now supplied to the non-inverting inlet of a comparator CP2 of the unit F', the inverting inlet of which has applied a reference voltage VR3 which provides a threshold voltage which determines the instant in which the battery is supplied as a result of triggering of T2.

The outlet of the comparator CP2, via the diode D3, is connected to the control gate of a unit H consisting of an electronic control switch T2, such as an SCR, arranged in series with the battery BA between the latter and the single winding W4 of the magneto generator.

The regulator according to FIG. 6 also comprises a further unit N consisting of a second voltage comparator CP1 which compares the voltage ramp VC generated by the unit E with a voltage V3 provided by a unit I. The unit N is such that when the voltage VC exceeds the voltage V3 of the unit I, which is directly related to the value of the voltage VB of the battery, this unit N, by means of the diode D1, triggers the electronic switch T1, causing it to conduct.

Since the voltage VB for charging the battery BA is normally fixed at about 14.5 volts for batteries with a nominal voltage of 12 volts, when the electronic switch T2 is conducting, the same voltage is also present on the A.C. load L, although, being limited solely to the positive half-waves, it does not allow the voltage VL of the A.C. load to exceed a desired value, for example of 13 volts, which is normally less than the charging voltage of the battery BA; in this way both the comparators CP1 and CP2 contribute to control of the effective voltage VL on the A.C. loads.

The unit I in turn consists of an operational amplifier A3 which is connected to the resistors R5, R6, R7 and R8, as a differential amplifier which amplifies, with a suitable gain, the difference between the voltage VB relating to the charged state of the battery BA, and a reference voltage VR4 indicative of the nominal voltage of the battery BA.

More precisely it is found that:

$$V3 = \frac{R7}{R5} + \frac{R8}{R6} * \frac{R6}{R7} * VB - \frac{R8}{R7} * VR4$$

so that the output voltage V3 of the unit I is:

zero when VB is less than a given value of the battery voltage, for example a value of 14.5 volts which is intermediate between the values typically required for the output voltages by the voltage regulator for the direct-current loads;

equal to VC Max for a small increase of VB in respect to the battery voltage referred to above, for example 0.2 volts.

The units B, C, D, E, F, N may again be comprised in a single digital unit governed by a microcontroller which, by means of three inlets which comprise analog-digital converters, is able to acquire the three signals VL, VB and VN and perform all the functions described.

Finally, in FIG. 6, CDI schematically represents a possible capacitive-discharge system of the type described in the patent U.S. Pat. No. 5,630,404, or corresponding EP application, to which reference is made by way of integral part of the present description.

Operation of the voltage regulator according to FIG. 6 will now be briefly described with reference to the above mentioned figure, as well as to FIGS. 7 to 11 of the accompanying drawings.

Let us assume that it is required to charge the battery BA to a voltage VB of 14.5 volts and supply the alternating-current load L at the voltage VL of 13.5 volts.

The operational amplifier A3 therefore has an output voltage V3 as follows:

zero if VB is less than 14.5 volts;

between 0 and V3 Max if VB is greater than 14.5 volts. V3 Max, as previously mentioned, corresponds to the maximum value assumed by the voltage ramp VC which in turn represents the integral of the positive half-wave of the voltage VG of the generator.

A good solution is that of making V3 assume the value of VC Max when VB is equal to 14.7 volts.

The voltage comparator CP1 compares the voltage VC with the voltage V3 and drives the electronic control switch T1 by means of the diode D1, keeping it in the conductive state for the angle $\alpha 2+\alpha 3$, while the control switch T2 is inoperative for the angle $\alpha 2$ and conducting for the angle $\alpha 3$.

As in the preceding case, during the angle $\alpha 1$ of each positive half-wave of the voltage VG, the magneto generator is in no-load condition since V2 is lower than the reference voltage VR3, and VC lower than the voltage V3. Thus none of the switches T1 and T2 is conductive. However, when T1 starts to conduct, the voltage V2 starts to rise until it reaches the value of VR3 (FIG. 9); at this point the voltage comparator CP2, by means of diode D3, will trigger the electronic control switch T2, keeping it in the conductive state for the remaining angle $\alpha 3$ of the positive half-wave of the voltage VG, thus causing current to flow towards the battery BA.

It is therefore evident that, when there are no loads on the battery BA, the mean current supplied to it will be that necessary for keeping it at the desired voltage, namely the voltage of 14.5 volts for a battery with a charge of 12 volts nominal (maintenance current).

The reference voltage VR3 determines simply a threshold voltage for the comparator CP2 which, when it is exceeded by V2, causes activation of the control switch T2 for charging the battery. The selection of VR3 must be effected so that the maximum deviation $\Delta$V2, between the maximum voltage and the minimum voltage which V2 reaches during each half-wave of the generator, is less than VR3 at the minimum working frequency of the generator.

To summarise, when VG is negative and during the angle $\alpha 1$, T1 and T2 will be blocked so that again no current will flow in the winding W4 of the voltage generator and in the voltage regulator itself; during the angle $\alpha 2$, only T1 will be conductive and therefore the A.C. load L will be supplied with the effective value of the voltage admissible for the load itself, while during the angle $\alpha 3$ both the switches T1 and T2 will be conductive.

If any loads applied to the battery BA cause the voltage VB to fall, then the voltage V3 also falls with the consequent advanced switching ON of T1 (with respect to the condition where these loads are absent); in this case there is a decrease in the angle $\alpha 1$ during which the generator is in a no-load condition. However, the required voltage value of the alternating-current load does not change and consequently the advanced switching ON of T1 will result in advanced switching ON of T2 and therefore in an increase in the angle $\alpha 3$ for a greater load current of the battery BA.

A further possible solution would be that of making the switch T1 which controls the alternating-current load L also operable in the switched-OFF state.

Figure 12:
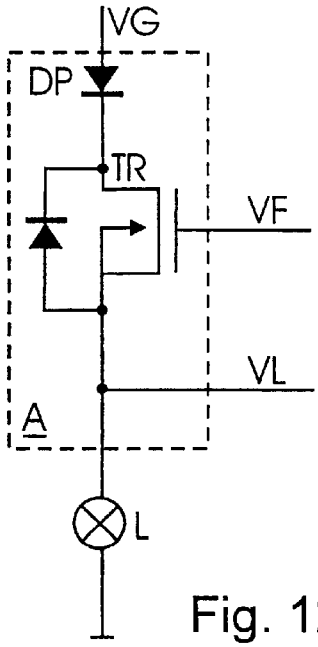
FIG. 12 shows the diagram of a power transistor which can be operated both in a conductive and a non conductive state for the control of an A.C. electric load.

This could be achieved by replacing the SCR1 of the block A with a diode DP and a transistor TR of suitable power (BJT, MOS, IGBT and the like), as can be seen in FIG. 12 or in any case with a device which is able to block the reverse voltage of the magneto generator and can be operated both in the conductive and non-conductive states.

As can be seen from FIG. 12, the power diode DP has the function of blocking the negative voltage half-waves, while the power transistor TP, in this case a power MOSFET, allows the flow of current for as long as it is biased on its control gate with the control voltage VF.

This solution, however, does not substantially modify the operation of the voltage regulator, but simply allows the switch T1 to be opened when the alternating-current load has the right voltage value; at this point the switch T2 is closed and therefore during the angle $\alpha 3$, differently from the previous case, T1 and T2 are never conducting at the same time. This fact reduces further the current in the generator, limiting further dissipation thereof.

From what has been said and illustrated in the accompanying drawings it will therefore be obvious that it has been possible to provide a method and a voltage regulator which allow for a selective control of the supply phases of the alternating-current and/or direct-current loads in electronic ignition circuits for internal combustion engines, so as to achieve the preset objects. Therefore, what has been said and illustrated with reference to the accompanying drawings has been provided purely by way of a non-limiting example of the claimed invention.

What we claim is:

1. Method for regulating the voltage supplied to A.C. and/or D.C. electric loads connected to a single winding magneto generator, and to the ignition circuit for an internal-combustion engine of a motor-vehicle, in which the electric loads are supplied with half-waves of the output voltage of the magneto generator having a first polarity, comprising the steps of:

connecting the electric loads to the single winding of the magneto generator, by an electronic control switch for controlling the voltage supplied in the electric loads during each feeding phase;

detecting the voltage existing on the electric loads;

regulating the voltage supplied to the electric loads by controlling the start and the time length of conductive state of the control switch, in relation to the voltage detected on the electric loads, during each period of the output voltage half-waves of the magneto generator having said first polarity; and maintaining no-load working conditions of the magneto generator during an initial period of time of each voltage half-wave, in which said control switch is in a non-conductive state.

2. Method according to claim 1 for regulating the voltage supplied to an A.C. electric load connectable to a single winding magneto-generator through an electronic control switch, the method comprising the steps of:

detecting the voltage on the A.C. electric load;

providing a first control voltage related to the detected voltage on the A.C. electric load;

generating a voltage ramp related to, and during each of the voltage half-waves of the magneto generator having a first polarity, zeroing said voltage ramp during each voltage half-wave having a second polarity opposite to the preceding one; and triggering the control switch into a conductive state to supply power to the A.C. electric load by applying to the control gate of the control switch a second control voltage provided by the comparison of said voltage ramp with said first control voltage, for an angle of each half-wave of said first polarity having a length sufficient to maintain the required nominal voltage on the A.C. electric load.

3. Method according to claim 1 for regulating the voltage supplied to A.C. and D.C. electric loads selectively connectable to a single winding magneto generator through a respective electronic control switch, the method comprising the steps of:

detecting the voltages on the A.C. and D.C. electric loads;

providing first and second control voltages each related to the detected voltage on the A.C. and D.C. electric loads;

providing a first reference voltage indicative of the nominal voltage of the D.C. electric load;

generating a voltage ramp related to, and during each of the voltage half-waves of the magneto generator having a first polarity, zeroing said voltage ramp during each voltage half-wave having a second polarity opposite to the preceding one;

providing a threshold voltage; and triggering said control switches into a conductive state to selectively supply the A.C. and respectively the D.C. electric loads by applying to the control gate of the control switches a control voltage provided by comparing said first control voltage with said threshold voltage and said second control voltage with said voltage ramp respectively, for an angle of each half-wave of said first polarity, having a length sufficient to maintain the required nominal voltages on the A.C. and D.C. electric loads.

4. A phase-controlled voltage regulator of the series type in particular for an A.C. electric load, in which the A.C. electric load is connectable in series to a single winding of a magneto generator during each half-wave of a first polarity, by an electronic switch controlled in relation to a voltage detected on the load itself, wherein the regulator comprises:

an A.C. load voltage-detection unit to provide a first control voltage proportional to the square value of the voltage detected on the A.C. electric load;

an inverting integrator unit having an inlet connected to the outlet of said A.C. voltage detection unit to provide a second control voltage related to the voltage supplied to the A.C. electric load and to a first reference voltage indicative of the effective voltage of the A.C. load;

a voltage inverting unit having an inlet connected to the outlet of said inverting integrator to invert said second control voltage with respect to a second reference voltage providing a third control voltage related to the effective voltage for the A.C. electric load;

a voltage-ramp generating unit to generate a voltage ramp related to each half-wave of a first polarity of the output voltage of the magneto generator, zeroing the voltage ramp during each half-wave having a second polarity opposite to the preceding one; and a voltage comparator to compare said voltage ramp with said third control voltage to apply during each half-wave of the first polarity, a control voltage to the control gate of the electronic switch to connect the A.C. electric load to the single winding of the magneto generator.

5. A voltage regulator according to claim 4, wherein said first voltage detection unit comprises a transconductance analog multiplier.

6. A voltage regulator according to claim 4, wherein said first voltage detection unit comprises an analog multiplier of logarithm-antilogarithm type.

7. A voltage regulator according to claim 4, wherein said inverting integrator unit comprises an operational amplifier, the inverting inlet of which is connected to the first voltage detection unit providing a voltage related to the effective A.C. load voltage, and the non-inverting inlet of which is connected to a reference voltage source indicative of the effective value voltage for the A.C. load.

8. A voltage regulator according to claim 4, wherein the voltage ramp generating unit comprises an integrator circuit for the half-waves of the generator voltage having a same polarity.

9. A voltage regulator according to claim 4, wherein said units are in the form of digital units.

10. A voltage regulator according to claim 4, wherein the A.C. electronic switch is of the type operable both in the conductive and non-conductive state.

11. A phase-controlled voltage regulator of the series type, in particular for A.C. and D.C. electric loads in which the A.C. and D.C. electric loads are selectively connectable to a single winding of a magneto generator during each half-wave of the output voltage having a same polarity, wherein said regulator comprises:

a first A.C. load voltage detection unit to provide a first control voltage proportional to the square value of the voltage detected on the A.C. electric load;

an inverting integrator unit having an inlet connected to the outlet of said A.C. voltage detection unit to provide a second control voltage related to voltage supplied to the A.C. electric load and to a first reference voltage indicative of the effective voltage of the A.C. load;

a voltage inverting unit having an inlet connected to the outlet of said inverting integrator to invert said second control voltage with respect to a second reference voltage and to provide a third control voltage related to the effective voltage for the A.C. electric load;

a voltage-ramp generating unit to generate a voltage ramp related to each half-wave of a first polarity of the output voltage of the magneto generator, zeroing the voltage ramp during each half-wave having a second polarity opposite to the preceding one;

and comprising a first voltage comparator to compare said third control voltage with a threshold voltage to generate a gate control voltage for a D.C. load control switch during each positive half-wave of the voltage of the magneto generator;

a D.C. voltage detection unit to provide a fourth control voltage related to the voltage difference between the voltage existing on the D.C. electric load and a third reference voltage indicative of the nominal voltage value for the D.C. electric load;

a second voltage comparator provided to compare said ramp voltage with said fourth control voltage, the voltage output of said second voltage comparator being connected to the control gate of an A.C. load control switch, to sequentially control a non conductive state and respectively a conductive state of said A.C. and D.C. control switches during each voltage half-wave of the magneto generator, having said first polarity.

12. A voltage regulator according to claim 11, wherein said first voltage detection unit comprises a transconductance analog multiplier.

13. A voltage regulator according to claim 11, wherein said first voltage detection unit comprises an analog multiplier of logarithm-antilogarithm type.

14. A voltage regulator according to claim 11, wherein said inverting integrator unit comprises an operational amplifier, the inverting inlet of which is connected to the first voltage detection unit providing a voltage related to the effective A.C. load voltage, and the non-inverting inlet of which is connected to a reference voltage source indicative of the effective value voltage for the A.C. load.

15. A voltage regulator according to claim 11, wherein the voltage ramp generating unit comprises an integrator circuit for the half-waves of the generator voltage having a same polarity.

16. A voltage regulator according to claim 11, wherein the D.C. electric load is a battery, and a non-inverting inlet of the second voltage comparator is connected to the outlet of the voltage ramp generating unit and the inverting inlet of said second comparator is connected to the outlet of a differential amplifier of said D.C. voltage detection unit, said differential amplifier comparing the battery voltage with a reference voltage such that the output voltage of said differential amplifier is zero when the detected voltage of the battery is less than the charging voltage value of the battery or is comprised between zero and a maximum voltage value, equal to the maximum value of said voltage ramp provided by the voltage ramp generating unit for a predefined increase in the voltage of the battery.

17. A voltage regulator according to claim 11, wherein said units are in the form of digital units.

18. A voltage regulator according to claim 11, wherein the A.C. electronic switch is of the type operable both in the conductive and non-conductive state.

* * * * *

UNITED STATES PATENT AND TRADEMARK OFFICE

CERTIFICATE OF CORRECTION

PATENT NO. : 6,111,393
DATED : August 29, 2000
INVENTOR(S) : Regazzi et al.

It is certified that error appears in the above-identified patent and that said Letters Patent is hereby corrected as shown below:

Drawings,
Replace Fig. 6 of the drawings, sheet 4 of 5, with the accompanying new Fig. 6, as shown on the attached page.

Signed and Sealed this

Seventeenth Day of August, 2004

JON W. DUDAS
*Acting Director of the United States Patent and Trademark Office*